US010583575B2

(12) United States Patent
Ntavos

(10) Patent No.: US 10,583,575 B2
(45) Date of Patent: Mar. 10, 2020

(54) SHAVING HEAD

(71) Applicant: BIC-VIOLEX S.A., Anixi (GR)

(72) Inventor: Vasileios Ntavos, Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 15/769,618

(22) PCT Filed: Dec. 16, 2016

(86) PCT No.: PCT/IB2016/057725
§ 371 (c)(1),
(2) Date: Apr. 19, 2018

(87) PCT Pub. No.: WO2017/103883
PCT Pub. Date: Jun. 22, 2017

(65) Prior Publication Data

US 2018/0311847 A1 Nov. 1, 2018

Related U.S. Application Data

(60) Provisional application No. 62/268,635, filed on Dec. 17, 2015.

(51) Int. Cl.

| | |
|---|---|
| ***B26B 21/40*** | (2006.01) |
| ***B26B 21/44*** | (2006.01) |
| ***B26B 21/06*** | (2006.01) |
| ***B26B 21/22*** | (2006.01) |

(52) U.S. Cl.
CPC ..... *B26B 21/4012* (2013.01); *B26B 21/4025* (2013.01); *B26B 21/4068* (2013.01); *B26B 21/443* (2013.01); *B26B 21/06* (2013.01); *B26B 21/225* (2013.01)

(58) Field of Classification Search
CPC . B26B 21/40; B26B 21/4012; B26B 21/4018; B26B 21/4025; B26B 21/4031; B26B 21/4037
USPC ..... 30/47–51
See application file for complete search history.

(56) References Cited

U.S. PATENT DOCUMENTS 4,253,236 A * 3/1981 Jacobson ..... B26B 21/521 30/47
4,403,412 A * 9/1983 Trotta ..... B26B 21/227 30/47
5,070,612 A * 12/1991 Abatemarco ..... B26B 21/227 30/50
5,092,042 A * 3/1992 Miller ..... B26B 21/4031 30/34.2

(Continued)

FOREIGN PATENT DOCUMENTS

| | | |
|---|---|---|
| EP | 2853362 A1 | 4/2015 |
| GB | 2411141 A | 8/2005 |
| WO | 2012/158142 A1 | 11/2012 |

OTHER PUBLICATIONS

International Search Report for PCT/IB2016/057725, dated Feb. 22, 2017.

*Primary Examiner* — Jason Daniel Prone
*Assistant Examiner* — Richard D Crosby, Jr.
(74) *Attorney, Agent, or Firm* — Polsinelli, PC

(57) ABSTRACT

A shaving head includes a housing, at least one component coupled with the housing, and at least one retainer coupled with the housing. The retainer secures the at least one component in the housing. The retainer also includes an anchor tooth received by the housing.

13 Claims, 4 Drawing Sheets

(56) References Cited

U.S. PATENT DOCUMENTS

| | | | | | |
|---|---|---|---|---|---|
| 5,253,420 | A * | 10/1993 | Althaus | B26B 21/227 | 30/47 |
| 5,590,468 | A * | 1/1997 | Prochaska | B26B 21/22 | 30/41 |
| 5,761,814 | A * | 6/1998 | Anderson | B26B 21/4068 | 30/50 |
| 5,822,862 | A * | 10/1998 | Ferraro | B26B 21/227 | 30/50 |
| 6,035,537 | A * | 3/2000 | Apprille, Jr. | B26B 21/227 | 30/346.5 |
| 6,305,084 | B1 * | 10/2001 | Zucker | B26B 21/22 | 30/50 |
| 7,191,523 | B2 * | 3/2007 | Miyazaki | B26B 21/22 | 30/346.5 |
| D617,948 | S * | 6/2010 | Lukan | D28/47 | |
| 7,748,121 | B2 * | 7/2010 | Coffin | B26B 21/227 | 30/47 |
| 8,544,177 | B2 * | 10/2013 | Rawle | B26B 21/227 | 30/50 |
| 8,782,903 | B2 * | 7/2014 | Clarke | B26B 21/4018 | 30/34.1 |
| 9,517,570 | B2 * | 12/2016 | Tucker | B26B 21/4031 | |
| 9,539,734 | B1 * | 1/2017 | Bozikis | B26B 21/227 | |
| 9,676,111 | B2 * | 6/2017 | Hahn | B26B 21/40 | |
| 2006/0080839 | A1 * | 4/2006 | Hesketh | B26B 21/222 | 30/50 |
| 2007/0056167 | A1 * | 3/2007 | Richard | B26B 21/227 | 30/50 |
| 2013/0205595 | A1 * | 8/2013 | Bykowski | B26B 21/4012 | 30/64 |
| 2018/0311847 | A1 * | 11/2018 | Ntavos | B26B 21/4012 | |

* cited by examiner

SHAVING HEAD

CROSS-REFERENCE TO RELATED APPLICATION

This application is a National Stage of International Application No. PCT/IB2016/057725, filed Dec. 16, 2016, which claims priority to U.S. Provisional Patent Application No. 62/268,635, which was filed in the U.S. Patent and Trademark Office on Dec. 17, 2015, all of which is incorporated herein by reference in its entirety for all purposes.

BACKGROUND

1. Field

The following description relates to shaving razors. A shaving razor may include a head with one or more blades and a retainer configured to retain components of the shaving head. For example, a shaving razor may include a head with one or more blades which are secured in the head by a retainer which is press fit onto the housing of the head. The retainer may include an anchor tooth which is received by the housing.

2. Description of Related Art

Shaving razors include shaving heads which contain components such as shaving blades, lubrication strips, guard bars, covers, and trimming blades. The components in conventional shaving heads would be individually and separately retained within the shaving head. As such, the components would each have separate retaining means; for example traditional clips may be utilized for each component. However, bending traditional clip legs at multiple locations of the cartridge provides for difficulties in manufacturing while also providing multiple locations for retaining the components and managing the applied tolerances.

Further, several disadvantages are typically encountered in the manufacture of such conventional mechanisms. During the manufacturing process, clips may encounter buckling as a result of force that is applied during installation of the clips. As a result of bending force exerted on the clips, the clips have a tendency to buckle upwards. Consequently, blade exposures may vary from intended blade exposure values. Also, during the manufacturing process, clips may fail to be properly installed in a razor housing, which requires additional attention and labor to ensure that all of the clips are properly installed in the housing. Thus, the manufacture of such conventional mechanisms is inefficient, which results in production delays and increased production costs.

SUMMARY

The present inventive concept provides a shaving razor that overcomes the aforementioned disadvantages of conventional shaving razors. The shaving razor of the present inventive concept generally includes a shaving head with a housing and one or more components. The components may be at least one blade, a guard bar, a cap, at least one lubrication strip, or a combination thereof. The components are partially covered and secured in the housing by at least one retainer. The at least one retainer may be press fit onto the housing, for example onto the side walls of the housing. An anchor tooth is provided in and extends from the retainers. The anchor tooth is received by a recess formed in the housing to securely couple the retainer with the housing. As such, the components are securely retained within the housing by the retainers.

The aforementioned may be achieved in an aspect of the present inventive concept by providing a shaving head having a housing, at least one component coupled with the housing, and at least one retainer coupled with the housing. The at least one retainer may secure the at least one component in the housing. The at least one retainer may include an anchor tooth received by the housing. The at least one component may include at least one blade, a guard bar, a cap, at least one lubrication strip, or a combination thereof. The housing may extend along a longitudinal axis. The housing may have a top side, a bottom side opposite to the top side, first and second longitudinal walls, and first and second side walls. The first and second longitudinal walls may each extend longitudinally along the longitudinal axis between the top and bottom sides. The first and second side walls may each extend between the first and second longitudinal walls. The number of retainers may be two. The retainers may couple with each of the first and second side walls. The at least one retainer may include a top wall and a side wall. The top wall of the retainer may overlap with the top side of the housing and secure the at least one component in the housing. The housing may be provided with at least one recess in at least one of the first and second side walls. The anchor tooth of the at least one retainer may be received by the corresponding at least one recess. The at least one recess may be formed in a lateral side of the housing. The at least one recess may have a size between about 1.5 mm and about 4 mm. The at least one recess may have a size of about 2.5 mm. The anchor tooth may be formed in the side wall of the at least one retainer. The anchor tooth may be formed in a lateral side of the side wall of the at least one retainer. The anchor tooth may extend from the at least one retainer about 0.5 mm to about 3 mm. The anchor tooth may extend from the at least one retainer about 1.5 mm. The at least one retainer may be made of a metal. The at least one retainer may be made of a plastic.

The aforementioned may be achieved in another aspect of the present inventive concept by providing a shaving razor. The shaving razor may include a handle and a shaving head coupled with the handle. The shaving head may include a housing, at least one component coupled with the housing, and at least one retainer coupled with the housing. The at least one retainer may secure the at least one component in the housing. The at least one retainer may include an anchor tooth received by the housing.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there are shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present inventive concept and, together with the description, serve to explain advantages and principles consistent with the present inventive concept.

DETAILED DESCRIPTION

Figure 1:
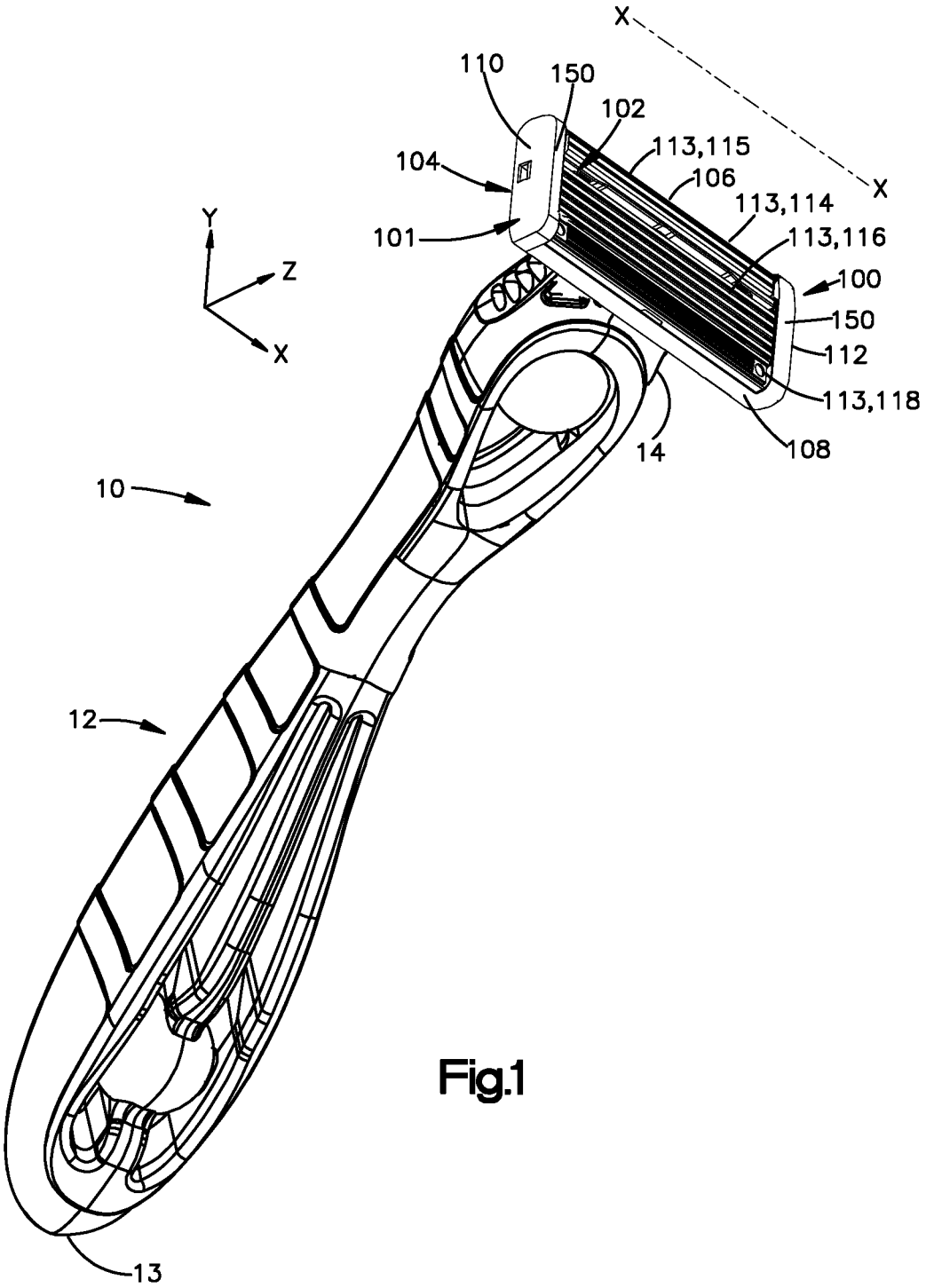
FIG. 1 is a diagram illustrating a perspective view of a shaving razor with a handle and a shaving head.

It is to be understood that the present inventive concept is not limited in its application to the details of construction and to the embodiments of the components set forth in the following description or illustrated in the drawings. The figures and written description are provided to teach any person skilled in the art to make and use the inventions for which patent protection is sought. The present inventive concept is capable of other embodiments and of being practiced and carried out in various ways. Persons of skill in the art will appreciate that the development of an actual commercial embodiment incorporating aspects of the present inventive concept will require numerous implementations—specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be, or become, apparent to one with skill in the art upon examination of the figures and the detailed description. It is intended that all such additional systems, methods, features, and advantages be included within this description, be within the scope of the present inventive concept, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be, or become, apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Figure 2:
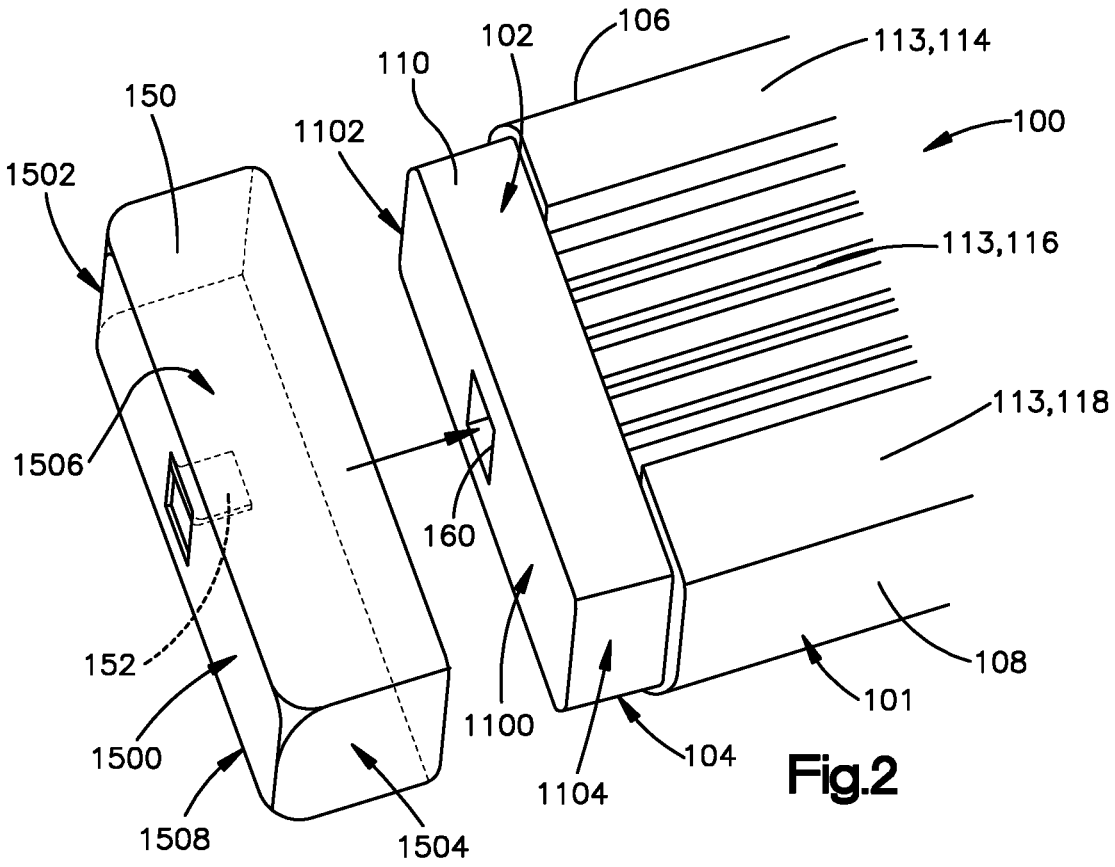
FIG. 2 is a diagram illustrating a partial, exploded, perspective view of a shaving head with one embodiment of a retainer.

FIGS. 1 and 2 illustrate a shaving razor 10 which includes a handle 12 coupled with a shaving head 100. The handle 12 extends in a handle direction between a proximal end 13 and a distal end 14. The shaving head 100 is coupled with the distal end 14 of the handle 12. In at least one example, the shaving head 100 may be removably coupled with the handle 12, for example, by a lock and release mechanism. In other examples, the shaving head 100 may be fixedly coupled with the handle 12 such that the shaving head 100 is not configured to be removably coupled with or selectively separated from the handle 12. The handle 12 may be operable to pivot relative to the shaving head 100. In other examples, the handle 12 may be secured to the shaving head 100 in a fixed relationship such that the shaving head 100 is not operable to pivot relative to the handle 12. The handle 12 may be any suitable shape to allow a user to securely grip the handle 12. It is foreseen that the handle 12 may include one continuous curve or include one straight portion or several curved and/or straight portions extending along an entirety or a substantial portion of the handle 12 without deviating from the scope of the present inventive concept.

The shaving head 100 includes a housing 101. The housing 101 extends along a longitudinal axis X-X. The housing 101, as illustrated, has a substantially rectangular shape, but may be any suitable shape such as ovoid or circular without deviating from the scope of the present inventive concept. The shaving head 100 and the housing 101 include a top side 102 and a bottom side 104 opposite the top side 102. The bottom side 104 is proximate to the handle 12, and the top side 102 includes at least one skin contacting area. The housing 101 includes first and second longitudinal walls 106, 108. Each of the first and second longitudinal walls 106, 108 extends longitudinally along the longitudinal axis X-X between the top and bottom sides 102, 104 and in a direction Z of the housing 101. The first and second longitudinal walls 106, 108, as illustrated, extend substantially parallel to each other. First and second side walls 110, 112 extend substantially parallel to each other and between the first and second longitudinal walls 106, 108 along a direction Y of the housing 101. The first and second side walls 110, 112 also extend between the top and bottom sides 102, 104 along the direction Z of the housing 101. The housing 101 may be made of plastic, metal, another suitable material, or any combination thereof without deviating from the scope of the present inventive concept.

The shaving head 100 includes a plurality of components 113 which assist and contribute to the shaving experience of the user. One of the components 113 is a plurality of blades 116 disposed and retained within the housing 101. The blades 116 extend along the longitudinal axis X-X. In at least one example, the shaving head 100 can include one, two, three, four, or more of the blades 116 without deviating from the scope of the present inventive concept. The blades 116 may be movably disposed or freely mounted, in the housing 101. For example, the blades 116 may be coupled with elastic fingers which extend from the housing 101. In other examples, the blades 116 may be fixedly disposed in the housing 101.

The components 113 of the shaving head 100 also include a cap 114, a lubricating strip 115, and a guard bar 118 included on and/or retained within the shaving head 100. The cap 114 is coupled with the first longitudinal wall 106. The lubricating strip 115 is disposed on the top side 102 of the cap 114 to deliver a friction reduction effect, an anti-irritation effect, and/or provide lubrication after shaving. The guard bar 118 is coupled with the second longitudinal wall 108 opposite the cap 114 to stretch the skin during shaving or dispense the forces applied to the skin, thereby causing the shaving head 100 to glide across the skin while providing a closer shave. The cap 114, the lubricating strip 115, and the guard bar 118 each extend along the longitudinal axis X-X. Additional components, e.g., a cover and/or one or more trimming blades, may also be included on and retained within the shaving head 100 without deviating from the scope of the present inventive concept.

The components 113 are retained within or on the shaving head 100 by retainers 150. For example, the retainers 150 are operable to retain the blades 116, the cap 114, the lubricating strip 115, and the guard bar 118 on or within the shaving head 100. As illustrated, the retainers 150 retain the components 113 by securely abutting and partially covering (i) a portion of the components, e.g., lateral sides or sides along the direction X of the components 113, and (ii) the side walls 110, 112. It is foreseen that the retainers 150 may be operable to secure one or more other components within or on the shaving head 100 without deviating from the scope of the present inventive concept. It is also foreseen that any one or more of the components 113 may be secured to the shaving head 100 without the retainers 150, e.g., via other means, without deviating from the scope of the present inventive concept.

As illustrated in FIG. 2, the first side wall 110 has a top side 102, a bottom side 104, a front side 1104, a back side 1102, and a lateral side 1100. It is foreseen that the shape of the first side wall 110 can be different, for example rounded or triangular, without deviating from the scope of the present inventive concept. The first side wall 110 includes a recess 160. As shown in FIG. 2, the recess 160 can be formed in the lateral side 1100 of the side wall 110. It is foreseen that the recess 160 can be formed in the front side 1104, the back side 1102, the top side 102, the bottom side 104, the lateral side 1100, or any combination thereof without deviating from the scope of the present inventive concept. The recess 160, as illustrated, is a rectangular recess. In other examples, the recess 160 can be any suitable shape, for example circular.

The retainer 150, as illustrated, corresponds to the shape and size of the first side wall 110. While the figures focus on the features between the retainer 150 and the first side wall 110, substantially similar features may be utilized with the second side wall 112. The retainer 150 has a top side 1506, a bottom side 1508, a front side 1504, a back side 1502, and a lateral side 1500. As such, the retainer 150 has a shape of a hollow rectangular prism with one wall omitted. The retainer 150 is shaped and sized to fit over the first side wall 110. While FIG. 2 illustrates that the retainer 150 is substantially symmetrical, it is foreseen that the retainer 150 can be asymmetrical without deviating from the scope of the present inventive concept, so long as a portion of the top side 1506 of the retainer 150 is press fit onto the first side wall 110 and covers a portion of and secures one or more components 113.

When the retainer 150 is placed onto and coupled with the housing 101, the retainer 150 is placed over the first side wall 110. The top side 1506 of the retainer 150 overlaps with the top side 102 of the housing 101. The lateral side 1500 of the retainer 150 also covers and may abut the lateral side 1100 of the housing 101. As illustrated in FIG. 2, the front and back sides 1504, 1502 of the retainer 150 also overlap with the front and back sides 1104, 1102 of the housing 101. It is foreseen that not all of the sides of the housing 101 are covered by the retainer 150 without deviating from the scope of the inventive concept, so long as the retainer 150 is securely coupled with the housing 101 and retains one or more of the components 113 within the housing 101.

To more securely retain the components 113 of the shaving head 100, the retainer 150 includes an anchor tooth 152. The anchor tooth 152 corresponds with the recess 160 formed in the housing 101. As illustrated in FIG. 2, the anchor tooth 152 is formed in the lateral side 1500 of the retainer 150 to correspond with the recess 160 formed in the lateral side 1100 of the housing 101. In other examples, the retainer 150 may include one or more anchor teeth 152 to correspond with the recesses 160 in the housing 101. As with the recesses 160, it is foreseen that the anchor tooth 152 can be formed in the front side 1504, the back side 1502, the top side 1506, the bottom side 1508, the lateral side 1500, or any combination thereof without deviating from the scope of the present inventive concept.

Figure 3:
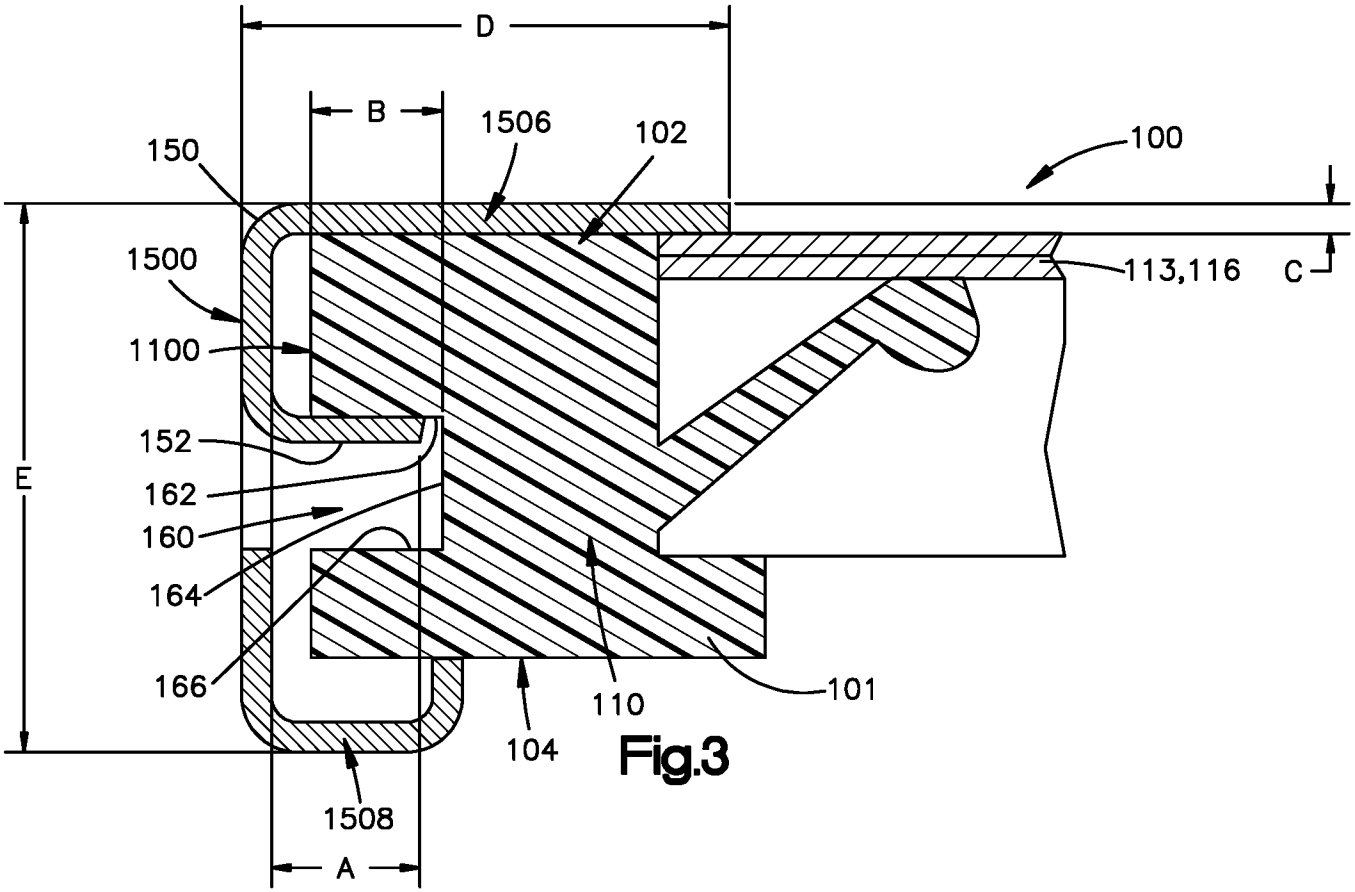
FIG. 3 is a diagram illustrating a partial, cross-sectional view of the shaving head of FIG. 2.

As illustrated in FIG. 3, the retainer 150 is coupled with the first side wall 110 of the housing 101. The top side 1506 of the retainer 150 overlaps with the top side 102 of the housing 101 and covers a portion of the components 113, including the blades 116. As such, the components 113 are retained and secured within the housing 101. The top side 1506 of the retainer 150 extends a length D about 3.9 mm from the lateral side 1500. The height E of the retainer 150, from the top side 1506 to the bottom side 1508, is about 4.7 mm. The height E of the retainer 150 defines the exposure of the blades 116. For example, the greater the height E corresponds to the blades 116 being allowed to rest at a higher position and, thus, closer to the skin. The length D and the height E of the retainer 150 can vary so long as the retainer 150 fits on the housing 101 of the shaving head 100. Also, the retainer 150 has a thickness C of about 0.5 mm. In other examples, the retainer 150 has a thickness C inclusive of, about, and/or between 0.5 mm and 1.2 mm to minimize bulkiness of the shaving head 100 and to keep the bending stresses low. As illustrated, the retainer 150 has a substantially uniform thickness. It is foreseen that the retainer 150 could be designed to have varying thicknesses throughout the retainer 150 without deviating from the scope of the present inventive concept.

The anchor tooth 152 is received in the recess 160 of the housing 101. The retainer 150, being coupled to the first and/or second side walls 110, 112 of the housing 101 with an anchor tooth 152, locks the retainer 150 in the X, Y, and Z directions. It is foreseen that the movement of the retainer 150 can be secured in at least one of the X, Y, and Z directions, for example only the Z direction, without deviating from the scope of the inventive concept. As illustrated in FIG. 3, the anchor tooth 152 abuts against the upper surface 162 of the recess 160 to help secure the retainer 150 in the Z direction. The anchor tooth 152, in the illustrated example, may abut the inside surface 164 to help secure the retainer 150 in the X direction. Further, in the illustrated example, the anchor tooth 152 may interact with the lower surface 166. In other examples, the lower surface 166 can be omitted such that the inside surface 164 forms part of the lateral side 1100 to meet with the bottom side 104. As such, the anchor tooth 152 secures the movement of the retainer 150 in the Z direction. The size A of the anchor tooth 152 is about 1.2 mm. In other examples, the size A of the anchor tooth 152 may be inclusive of, about, and/or between 1 mm and 3 mm. Correspondingly, the recess 160 in the housing 101 has a size B of about 2.5 mm to fit the anchor tooth 152. In other examples, the size B of the recess 160 may be inclusive of, about, and/or between 2 mm and 4 mm. It is foreseen that the dimensions of the anchor tooth 152 and the recess 160 may vary without deviating from the scope of the present invention, so long as the recess 160 can receive the anchor tooth 152 to securely couple the retainer 150 with the housing 101.

The retainer 150 is made of metal. In other examples, the retainer 150 may be made of plastic or any other suitable material such that the retainer 150 can couple with the housing 101 and have the structural integrity to securely retain the components 113 in the housing 101.

When manufacturing the retainer 150, the anchor tooth 152 may be formed by punching. A mechanical module places the retainer 150, by press fitting, onto the shaving head 100. A machine tool punches the retainer 150 at the designated area corresponding to the recess 160 in the housing 101 to form the anchor tooth 152. The anchor tooth 152 locks the retainer 150 on to the shaving head 100, ensuring the proper and secure retaining of the components 113.

Figure 4:
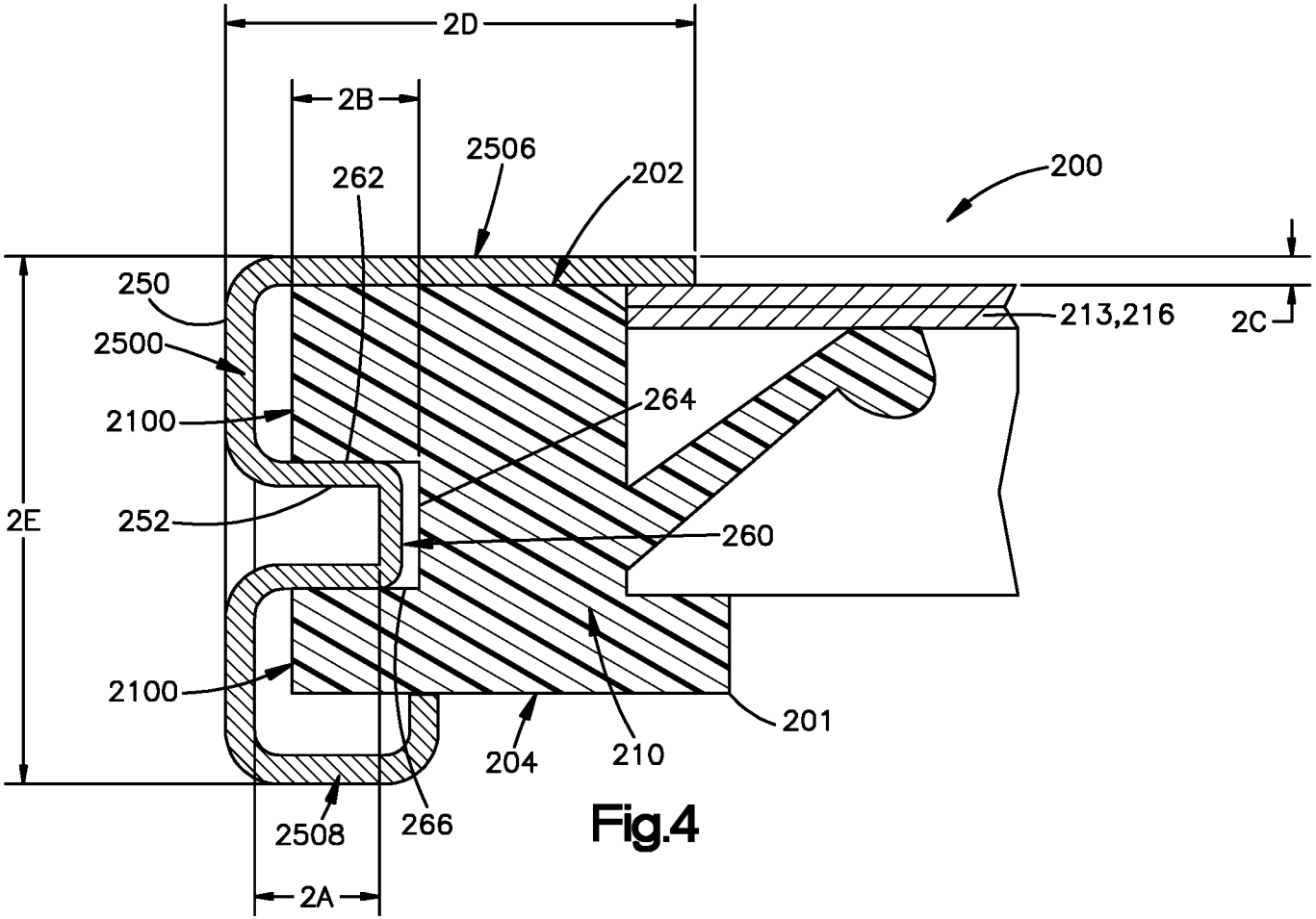
FIG. 4 is a diagram illustrating a partial, exploded, perspective view of a shaving head with another embodiment of a retainer.

Turning to FIG. 4, another embodiment of the present inventive concept is illustrated with a shaving head 200. Similar to the embodiment illustrated in FIGS. 1-3, the shaving head 200 includes a plurality of components 213 which assist and contribute to the shaving experience of the user. One of the components 213 is a plurality of blades 216 disposed and retained within the housing 201. The blades 216 extend along the longitudinal axis X-X. In at least one example, the shaving head 200 can include one, two, three, four, or more of the blades 216 without deviating from the scope of the present inventive concept. The blades 216 may be movably disposed or freely mounted, in the housing 201. For example, the blades 216 may be coupled with elastic fingers which extend from the housing 201. In other examples, the blades 216 may be fixedly disposed in the housing 201.

The components 213 of the shaving head 200 also include a cap, a lubricating strip, and a guard bar included on and/or retained within the shaving head 200. Additional components, e.g., a cover and/or one or more trimming blades, may also be included on and retained within the shaving head 100 without deviating from the scope of the present inventive concept.

A plurality of the components 213 is retained within the shaving head 200 by retainers 250. For example, the retainers 250 are operable to retain the blades 216, the cap, the lubricating strip, and the guard bar within the shaving head 200. The retainers 250 may be installed in each of the two side walls of the housing 201. It is foreseen that the retainers 250 may be installed in other walls or only one of the side walls of the housing 201 as desired without deviating from the scope of the present inventive concept. As illustrated, the retainers 250 retain the components 213 by securely abutting and partially covering (i) a portion of the components 213, e.g., lateral sides or sides along the direction X of the components 213, and (ii) the side walls 210, 212. It is foreseen that the retainers 250 may be operable to secure one or more other components 213 within or on the shaving head 200 without deviating from the scope of the present inventive concept. It is also foreseen that any one or more of the components 213 may be secured to the shaving head 200 without the retainers 250, e.g., via other means, without deviating from the scope of the present inventive concept.

Similar to FIGS. 2 and 3, the first side wall 210 has a top side 202, a bottom side 204, and a lateral side 2100. It is foreseen that the shape of the first side wall 210 can be different, for example rounded or triangular, without deviating from the scope of the present inventive concept. The first side wall 210 of the housing 201 includes a recess 260. As shown in FIG. 4, the recess 260 can be formed in the lateral side 2100 of the side wall 210. It is foreseen that the recess 260 can be formed in the front side, the back side, the top side 202, the bottom side 204, the lateral side 2100, or any combination thereof without deviating from the scope of the present inventive concept. The recess 260, as illustrated, is a rectangular recess. In other examples, the recess 260 can be any suitable shape, for example circular.

The retainer 250, as illustrated, corresponds to the shape and size of the first side wall 210. While the figures focus on the features between the retainer 250 and the first side wall 210, substantially similar features may be utilized with the second side wall 212. The retainer 250 has a top side 2506, a bottom side 2508, a front side, a back side, and a lateral side 2500. As such, the retainer 250 has a shape of a hollow rectangular prism with one wall omitted. In other examples, the bottom side 2508 of the retainer 250 may be omitted, such that an anchor tooth 250 interaction with the recess 260 can provide the securing forces needed for locking the retainer 250 in the X, Y, and Z directions. The retainer 250 is shaped and sized to fit over the first side wall 210. It is foreseen that the retainer 250 can be symmetrical or asymmetrical without deviating from the scope of the present inventive concept, so long as a portion of the top side 2506 of the retainer 250 is press fit onto the first side wall 210 and covers a portion of and secures one or more components 213.

When the retainer 250 is placed onto and coupled with the housing 201, the retainer 250 is placed over the first side wall 210. The top side 2506 of the retainer 250 overlaps with the top side 202 of the housing 201. The lateral side 2500 of the retainer 250 also covers and may abut the lateral side 2100 of the housing 201. It is foreseen that not all of the sides of the housing 201 are covered by the retainer 250 without deviating from the scope of the inventive concept, so long as the retainer 250 is securely coupled with the housing 201 and retains one or more of the components 213 within the housing 201.

To more securely retain the components 213 of the shaving head 200, the retainer 250 includes an anchor tooth 252. The anchor tooth 252 is a bump-shaped component. As such, the retainer 250 does not have any material that is broken or torn away. The anchor tooth 252 corresponds with the recess 260 formed in the housing 201. As illustrated in FIG. 4, the anchor tooth 252 is formed in the lateral side 2500 of the retainer 250 to correspond with the recess 260 formed in the lateral side 2100 of the housing 201. In other examples, the retainer 250 may include one or more anchor teeth 252 to correspond with the recesses 260 in the housing 201. As with the recesses 260, it is foreseen that the anchor tooth 252 can be formed in the front side, the back side, the top side 2506, the bottom side 2508, the lateral side 2500, or any combination thereof without deviating from the scope of the present inventive concept.

As illustrated in FIG. 4, the retainer 250 is coupled with the first side wall 210 of the housing 201. The top side 2506 of the retainer 250 overlaps with the top side 202 of the housing 201 and covers a portion of the components 213, including the blades 216. As such, the components 213 are retained and secured within the housing 201. The top side 2506 of the retainer 250 extends a length 2D about 3.9 mm from the lateral side 2500. The height 2E of the retainer 250, extending from the top side 2506 to the bottom side 2508, is about 4.7 mm. The length 2D and the height 2E of the retainer 250 can vary so long as the retainer 250 fits on the housing 201 of the shaving head 200. Also, the retainer 250 has a thickness 2C of about 0.5 mm. In other examples, the retainer 250 has a thickness 2C inclusive of, about, and/or between 0.5 mm and 1.2 mm to minimize bulkiness of the shaving head 200 and to keep the bending stresses low. As illustrated, the retainer 250 has a substantially uniform thickness. It is foreseen that the retainer 250 could be designed to have varying thicknesses throughout the retainer 250 without deviating from the scope of the present inventive concept.

The anchor tooth 252 is received by the recess 260 of the housing 201. The retainer 250, being coupled to the first and/or second side walls 210, 212 of the housing 201 with an anchor tooth 252, locks the retainer 250 in the X, Y, and Z directions. It is foreseen that the movement of the retainer 250 can be secured in at least one of the X, Y, and Z directions, for example only the Z direction, without deviating from the scope of the inventive concept. The recess 260 has an upper surface 262, an inner surface 264, and a lower surface 266. As the anchor tooth 252 is a bump-shaped component, the anchor tooth 252 may abut the upper surface 262, the inner surface 264, and the lower surface 266. In other examples, the lower surface 266 can be omitted such that the inside surface 264 forms part of the lateral side 2100 to meet with the bottom side 204. As such, the anchor tooth 252 secures the movement of the retainer 250 in the Z direction. It is foreseen that the anchor tooth 252 may not abut all of the surfaces at once and may abut one or more than one of the surfaces 262, 264, 266 of the recess 260 at any given time without deviating from the scope of the present inventive concept, so long as the anchor tooth 252 securely couples the retainer 250 with the housing 201.

The size 2A of the anchor tooth 252 is about 1 mm. In other examples, the size 2A of the anchor tooth 252 may be inclusive of, about, and/or between 0.5 mm and 2 mm. Correspondingly, the recess 260 in the housing 201 has a size 2B of about 2 mm to fit the anchor tooth 252. In other examples, the size 2B of the recess 260 may be inclusive of, about, and/or between 1.5 mm and 3 mm. It is foreseen that the dimensions of the anchor tooth 252 and the recess 260 may vary without deviating from the scope of the present invention, so long as the recess 260 can receive the anchor tooth 252 to securely couple the retainer 250 with the housing 201.

The retainer 250 is made of metal. In other examples, the retainer 250 may be made of plastic or any other suitable material such that the retainer 250 can couple with the housing 201 and have the structural integrity to securely retain the components 213 in the housing 201.

When manufacturing the retainer 250, the anchor tooth 252 may be formed by punching. A mechanical module places the retainer 250, by press fitting, onto the shaving head 200. A machine tool punches the retainer 250 at the designated area corresponding to the recess 260 in the housing 201 to form the anchor tooth 252. The machine tool punches the retainer 250 such that the anchor tooth 252 is a bump-shaped component. The anchor tooth 252 locks the retainer 250 on to the shaving head 200, ensuring the proper and secure retaining of the components 213.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A head for a shaving razor, the head comprising:

a housing extending along a longitudinal axis;

at least one component coupled with the housing; and at least one retainer, the at least one retainer having a top side which overlaps a top side of the housing, an opposing parallel bottom side which overlaps at least a portion of a bottom side of the housing, a first side wall and an opposing parallel second side wall extending perpendicular to the top and bottom side walls and which overlaps at least a portion of a respective front side and rear side of the housing, and a lateral side which extends perpendicular to the top, the bottom, the first, and the second side walls to cover and abut at least a portion of a lateral side of the housing;

the retainer including at least one anchor, the anchor being received by the housing to be coupled with the housing and the retainer secures the at least one component within the housing.

2. The head of claim 1, wherein the at least one component includes at least one blade, a guard bar, a cap, at least one lubrication strip, or a combination thereof.

3. The head of claim 1, wherein the at least one retainer is two retainers, each of the two retainers coupling, respectively, with the first and second side walls.

4. The head of claim 1, wherein the housing includes at least one recess in at least one of the first and second side walls, the anchor of the at least one retainer corresponding to and being received by the at least one recess.

5. The head of claim 4, wherein the at least one recess is formed in a lateral side of the housing.

6. The head of claim 4, wherein the at least one recess has a size between about 1.5 mm and about 4 mm.

7. The head of claim 4, wherein the at least one recess has a size between about 2.5 mm.

8. The head of claim 1, wherein the anchor is formed in the side wall of the at least one retainer.

9. The head of claim 1, wherein the anchor is formed in a lateral side of the side wall of the at least one retainer.

10. The head of claim 1, wherein the anchor tooth extending from the at least one retainer about 0.5 mm to about 3 mm.

11. The head of claim 1, wherein the anchor extends from the at least one retainer about 1.5 mm.

12. The head of claim 1, wherein the at least one retainer is made of a metal.

13. The head of claim 1, wherein the at least one retainer is made of a plastic.

* * * * *